US006083062A

United States Patent [19]

Treloar et al.

[11] Patent Number: 6,083,062

[45] Date of Patent: Jul. 4, 2000

[54] PORTABLE PEDAL-OPERATED PADDLEWHEEL BOAT

[76] Inventors: Lester A. Treloar; Richard Brooks, both of 171 Bedford Drive N.E., Calgary, Alberta, Canada, T3K 2N9

[21] Appl. No.: 09/361,518

[22] Filed: Jul. 27, 1999

[51] Int. Cl.[7] ..... B63H 16/20

[52] U.S. Cl. ..... 440/30; 440/90; 114/354; 114/61.1

[58] Field of Search ..... 114/144 R, 61.1, 114/353, 354; 440/12.55, 12.58, 12.62, 12.64, 21, 26, 29, 30, 90

[56] References Cited

U.S. PATENT DOCUMENTS

| | | | |
|---|---|---|---|
| 2,253,936 | 8/1941 | Karst . | |
| 3,148,656 | 9/1964 | Schwarzer | 440/30 |
| 3,225,733 | 12/1965 | Schwarzer | 440/30 |
| 3,327,674 | 6/1967 | Schwarzer | 440/30 |
| 4,496,325 | 1/1985 | Tweg . | |
| 4,648,846 | 3/1987 | Hsu . | |
| 4,698,034 | 10/1987 | Anthonijsz . | |
| 4,782,777 | 11/1988 | Sussman . | |
| 4,938,162 | 7/1990 | Hanlon . | |
| 5,174,232 | 12/1992 | Boddy . | |
| 5,183,422 | 2/1993 | Guiboche . | |

*Primary Examiner*—Stephen Avila
*Attorney, Agent, or Firm*—Sean W. Goodwin

[57] ABSTRACT

A lightweight, collapsible boat comprises twin parallel hulls, a frame and human-powered paddlewheels outboard of the two hulls. The boat's frame is capable of being collapsed and packed into a bundle for carrying as a backpack. The drive comprises a pedal drive for turning a short drive axle which is independently and releasably coupled to paddlewheel driveshafts. Steering of the boat is accomplished by selective engaging and disengaging of the left and right couplings The frame comprises a steering column, an operator's seat support, rear hull spacing members and front hull spacing members which support the driveshafts. The couplings can be fully disengaged for releasing the driveshafts and permitting the front spacing members and driveshafts to pivot at the bottom of the steering column, along with the rear spacing members and seat support for forming a bundle of parallel members suitable for transport, preferably as a backpack

14 Claims, 10 Drawing Sheets

PORTABLE PEDAL-OPERATED PADDLEWHEEL BOAT

FIELD OF THE INVENTION

The invention relates to the field of boats and more particularly to the field of human-powered pedal-operated paddlewheels for boats.

BACKGROUND OF THE INVENTION

Human-powered paddlewheel boats are well known for recreational use and have been available in a number of different forms over the years.

Portability, maneuverability and speed are design factors which are often contrary. The prior art has not been entirely successful in achieving all of the above factors in combination.

As early as 1938, in U.S. Pat. No. 2,253,936 to Karst, hand-cranked paddlewheels were positioned either side of a floating craft which was capable of seating several persons, positioned about game boards, such as a checker board. Three floats, such as toroidal inflatable tubes, are placed in a line and secured together with two long peripheral beams. Having a function like oars, paddlewheels are positioned amidships on each side of the craft. Each paddlewheel rotational shaft is fixed to hand cranks. While the craft appears stable, due in part to its length, it is unlikely very maneuverable, and having floats which extend transverse to the direction of movement makes it unlikely to be particularly swift.

In U.S. Pat. No. 5,183,422 to Guiboche, the maneuverability issue is addressed by providing a single toroidal inflatable tube float. The operator sits atop a platform secured to the tube. Two independently driven paddlewheels are positioned within the inner radius of the float and below the platform. Pedals are mounted on S-shaped axles. The axle's ends terminate above the two paddlewheels and belt drives drive the paddlewheels. Two levers, operated by the operators left and right hands actuate engagement and disengagement of the pedal drive and paddlewheels for enabling steering. Engagement is through axially engaging and disengaging a splined shaft within the splined bore of the paddlewheel. Spring-biasing maintains the drives engaged state. By selectively driving only one of the two paddlewheels, turns can be made. While the ability to turn is likely very good, forward movement is again impeded by the use of the toroidal tube float.

Another desirable feature is the ability to easily transport the boat to a recreation site. This ability is addressed in part in U.S. Pat. No. 5,174,232 to Boddy. Boddy discloses an inflatable catamaran having a substantially three part planer frame which assembles to lie across the linearly elongate inflatable tubes forming two hulls. The frame forms a platform on a catamaran for powering by sail, motor or oars. This design, while it allows the frame to be tri-folded, with or without the hulls attached, positions the operator at the hull level, and does not integrate pedal drive means into the frame.

The boat of Karst is not realistically collapsible for transport. The paddle boat of Guiboche does not contemplate portability other than describing the disassembly and re-assembly of the platform into four separate sections. Further, the drive arrangement of Guiboche is constrained to be at least as wide as the S-shape axle when disassembled, which extends transversely and fully to the paddlewheels.

Accordingly, there is a yet a human-powered, pedal-driven boat which satisfies the criteria of utilizing an efficient streamlined hull arrangement, providing great maneuverability and enabling luggable portability for transport.

SUMMARY OF THE INVENTION

A human-powered pedal-driven paddlewheel boat is provided that has stability and speed, largely due to its' streamlined catamaran styled hull. Maneuverability is achieved with the use of two outboard paddlewheels. The boat is designed to be extremely portable and is capable of being folded and packed into a bundle light enough and small enough to be carried as a backpack. The portability of the boat is due to the arrangement of the driveshafts and the short drive axle which are removeably and independently coupled, allowing folding of the boat frame. It is now possible for hikers to carry a versatile boat into the backcountry for improved recreational access and in particular, fishing.

Therefore, in a broad aspect, a human-powered pedal-driven paddlewheel boat is provided comprising a pair of linear pontoons arranged and spaced by a tubular frame forming a catamaran styled hull. A paddlewheel is located on each outboard side of the hull, each having an independent rotary drive shaft removeably and independently coupled by a pin and slot to a drive axle. A pedal-powered chain-drive drives the drive axle, driveshafts and paddle wheels. A steering column when turned right or left actuates a steering fork whose left or right tines act to disengage the pin and slot mechanism resulting in an uncoupling of the respective paddlewheel with the effect of turning of the boat.

Preferably, the pedals are mounted on a swing arm tethered to the steering column to allow greater flexibility of positioning of the pedals. Adjustment of the length of the tether positions the pedals to accommodate operators having different leg lengths as well as providing the option of operating the pedal drive by hand, when in the fully upright position. Further, the swing arm adds to the portability of the boat as the pedal drive can be placed in the fully upright position adjacent the steering column.

The frame is substantially constructed of lightweight aluminum tubing fastened by bolts which can be removed or loosened to create pivot points which allow the frame to be folded, along with the decoupled driveshafts, into a compact bundle of a plurality of parallel members.

BRIEF DESCRIPTION OF THE DRAWINGS

FIG. 5*a* is a side view of a paddlewheel;

FIG. 5*b* is a sectional cut along radial section lines C—C of FIG. 5*a;*

FIG. 5*c* is a partial sectional end view of a single paddle of FIG. 5*b;*

DETAILED DESCRIPTION OF THE PREFERRED EMBODIMENT

Figure 1:
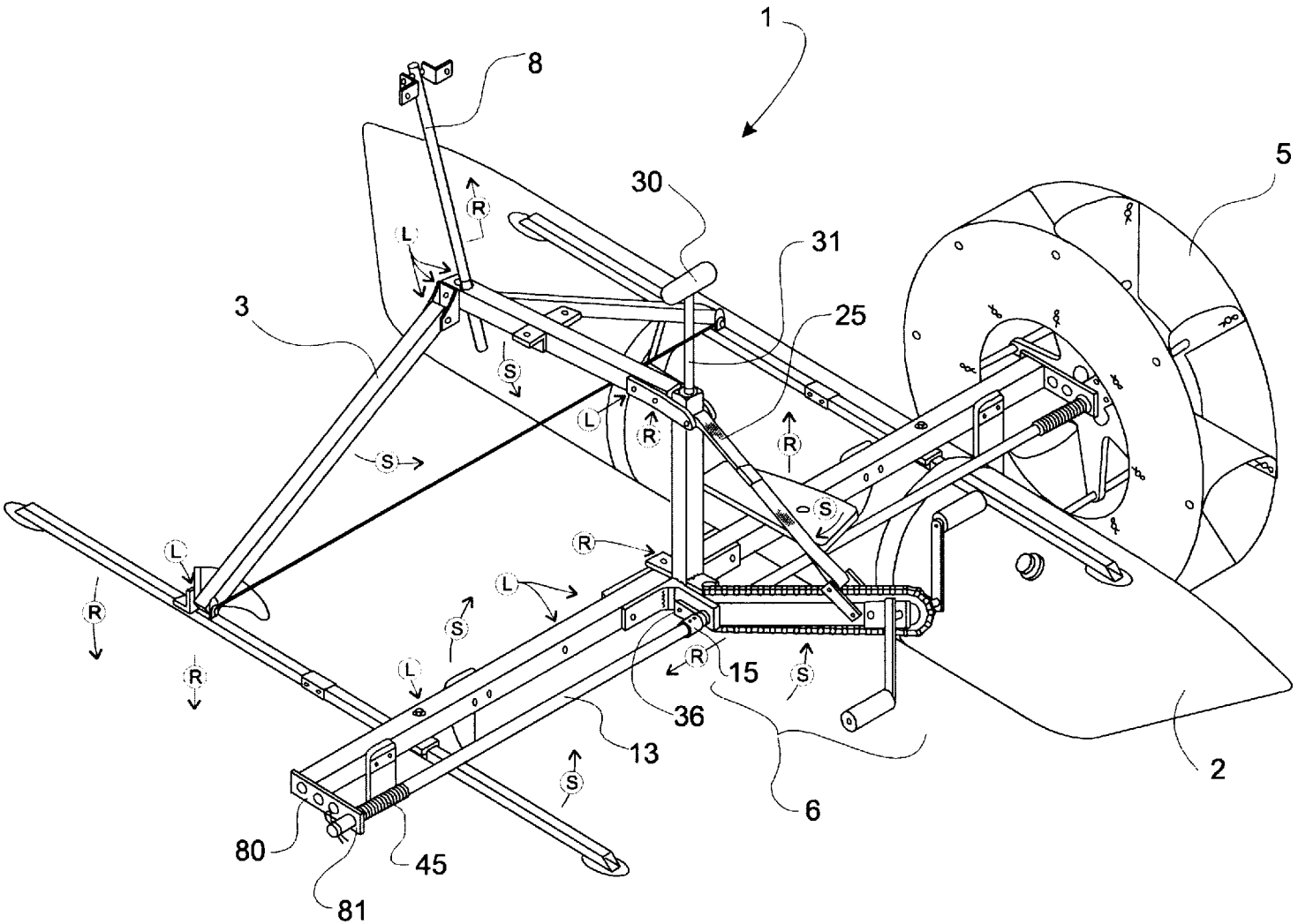
FIG. 1 is a perspective view of a paddlewheel boat according to an embodiment of invention. The starboard side pontoon and paddlewheel are shown removed for clarity.

Having reference to FIGS. 1–4, a human-powered boat 1 is shown having hulls or pontoons 2 (FIGS. 2–4), a frame 3, a seat 4, paddlewheels 5 and paddlewheel drive means 6. In FIG. 1, the starboard (right-side) pontoon and paddlewheel are not shown for clarity of the other components. The terms starboard and port are used interchangeably with the terms right and left respectively throughout, depending on the context.

The pontoons 2 are of vinyl welded construction and are deflatable. The pontoons 2 are spaced apart and parallel for forming a catamaran arrangement. The frame 3 spaces the pontoons 3 and supports the operator above the boat 1. A backrest 7 and tube 8 extend upwardly from the seat 4. The seat 4 is positioned on the frame 3 so as to place the operator roughly over the center of gravity of the boat 1. The frame 3 is a structural skeletal arrangement of aluminum members for minimizing weight.

The length of the pontoons 2 and their spacing sets the overall dimensions of the boat 1, being substantially square for maximizing stability while also maintaining maneuverability.

The paddlewheels 5 are positioned outboard of the port and starboard pontoons 2 respectively. The outboard paddlewheel positioning and substantially square frame maximizes maneuverability.

Figure 2:
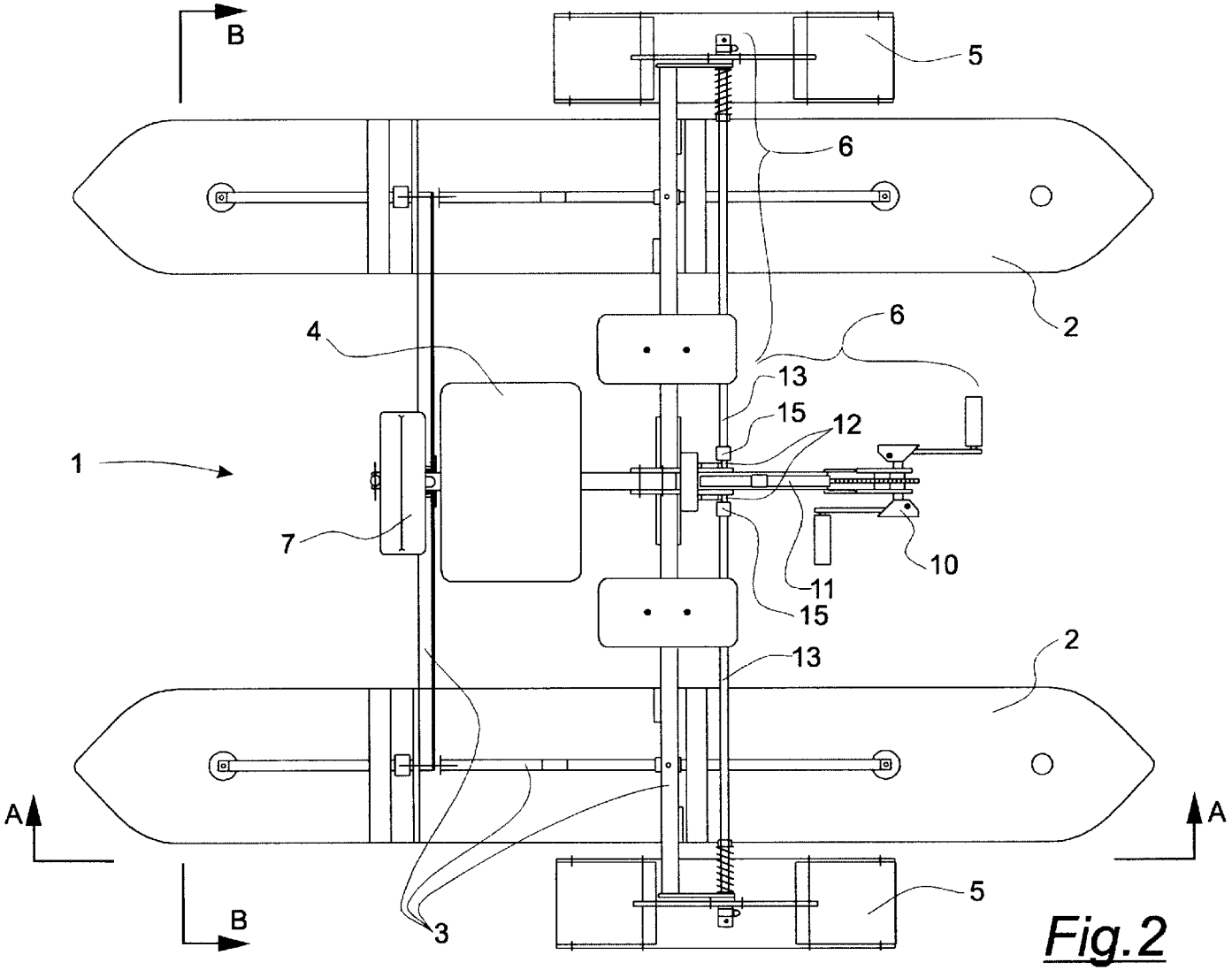
FIG. 2 is a plan view of the paddlewheel boat.
Figure 7:
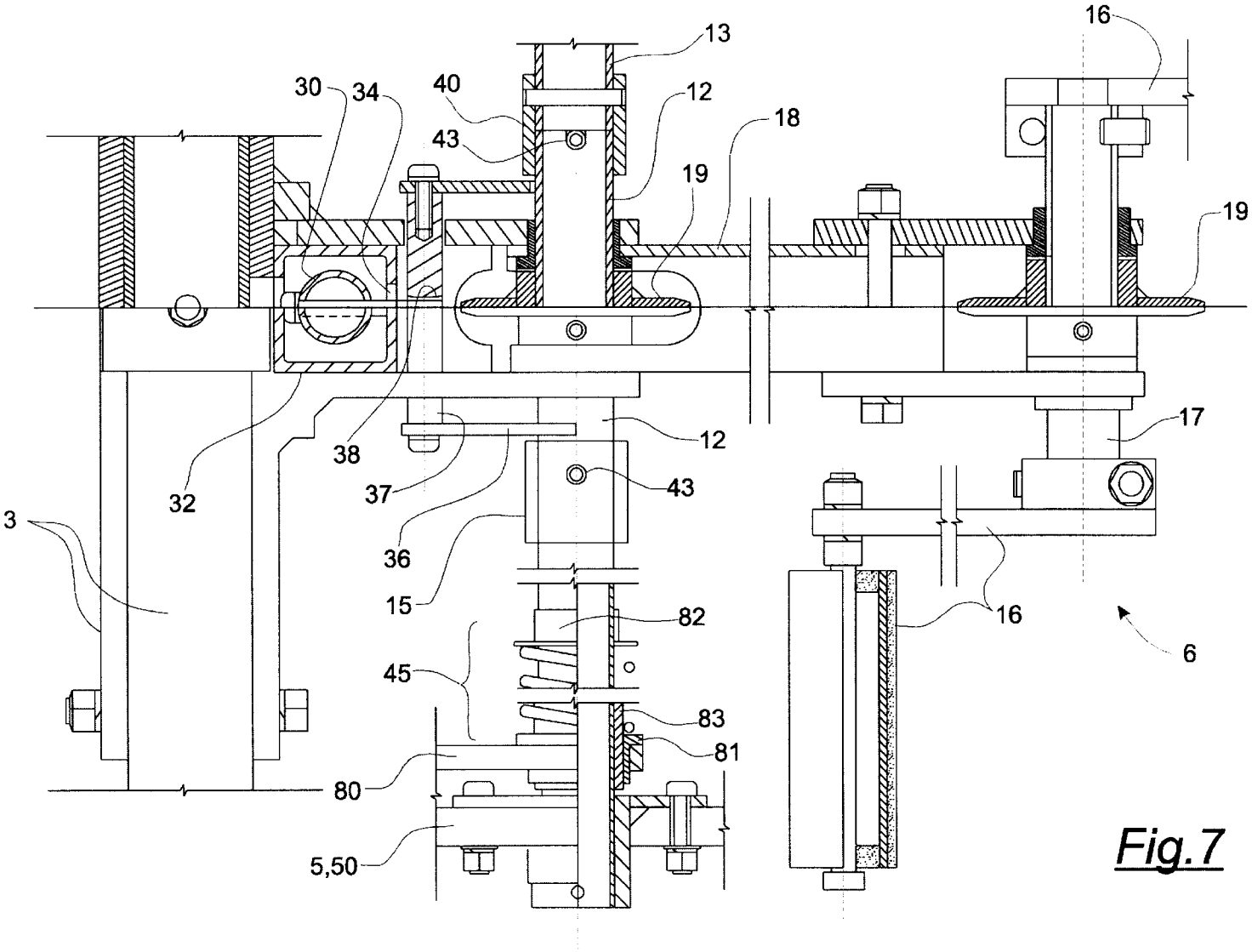
FIG. 7 is a partial plan and a partial sectional view of the drive and steering means. The starboard side of the view is mostly a plan view and the port side is sectioned.
Figure 8:
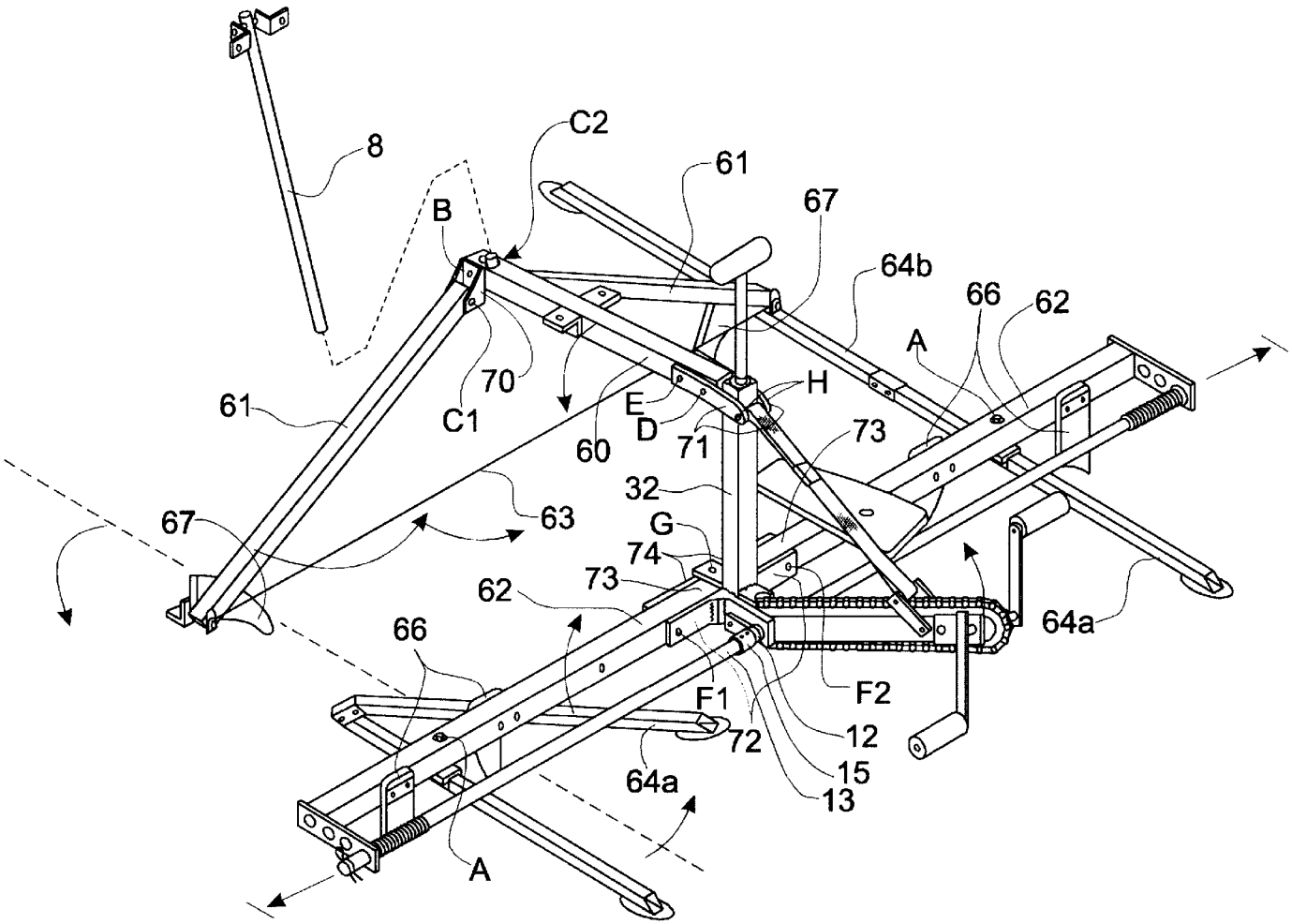
FIG. 8 is a perspective view of the frame of the boat in the initial stages of disassembly with the paddlewheels, pontoons, seat and backrest removed and the frame being folded.
Figure 9:
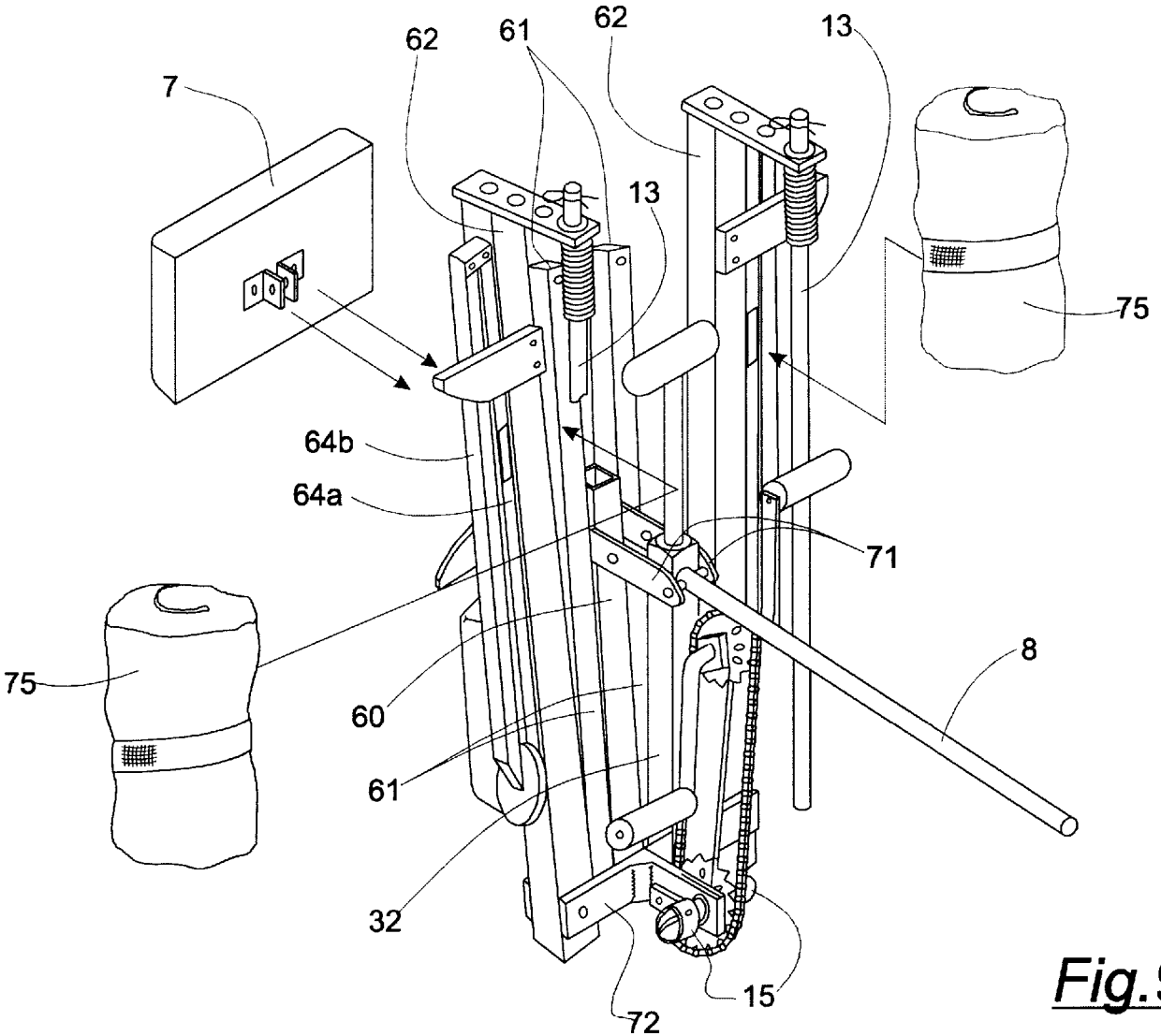
FIG. 9 is a perspective, partially view of the frame substantially fully folded with the folded pontoon packages and backrest ready for packing an d with the backrest tube positioned for subsequent mounting and storage of the paddlewheels.

Best seen in FIGS. 2 and 7, the drive means 6 comprises pedal drive 10, transmission means 11 and a drive axle 12. Paddlewheel driveshafts 13 extend co-linearly from the drive axle and to each paddlewheel 5. The driveshafts are not part of the frame but supported thereby. Coupling means 15 independently couple the drive axle 5 to the driveshafts 13.

Figure 6:
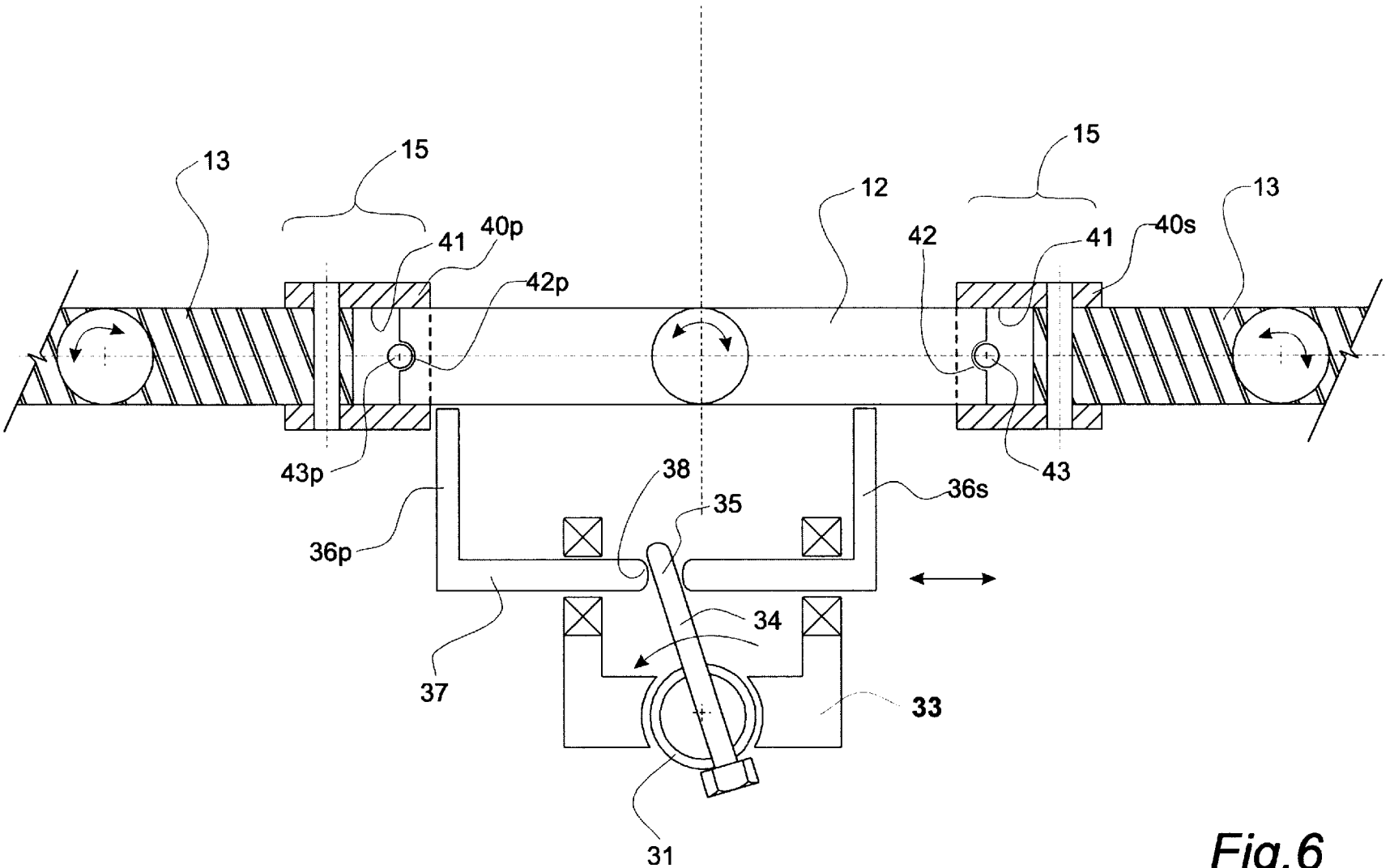
FIG. 6 is a partial diagrammatic illustration of the steering shaft and pin actuating the shift arms for a turn to port.

The coupling means 15, as shown in FIGS. 6 and 7, comprise complementary radial slots and pins formed at the interfaces of the port and starboard ends of the drive axle and the port and starboard driveshafts. Actuation of the coupling means causes axial movement between the pin and slot. In the engaged position, axial engaging of a pin (male) and slot (female), rotationally locks the drive axle and driveshaft for driving the associated paddlewheel. In the disengaged position, axial disengagement of a pin and slot permits relative rotation between the drive axle and driveshaft. By engaging one driveshaft and disengaging the other, steering is accomplished.

The pedal drive 10 has a pair of cranks 16, on a front axle 17 rotatably supported on the front end of a swing arm 18. At its other end, the swing arm is rotatably supported about the drive axle 12. The transmission means 11 is a chain drive. Both the front axle 17 and drive axle 12 are fitted with chain sprockets 19 connected by an endless chain 20 (FIG. 1). The drive axle 12, front axle 17 and driveshafts 13 are rotatably supported in bushings.

Figure 3:
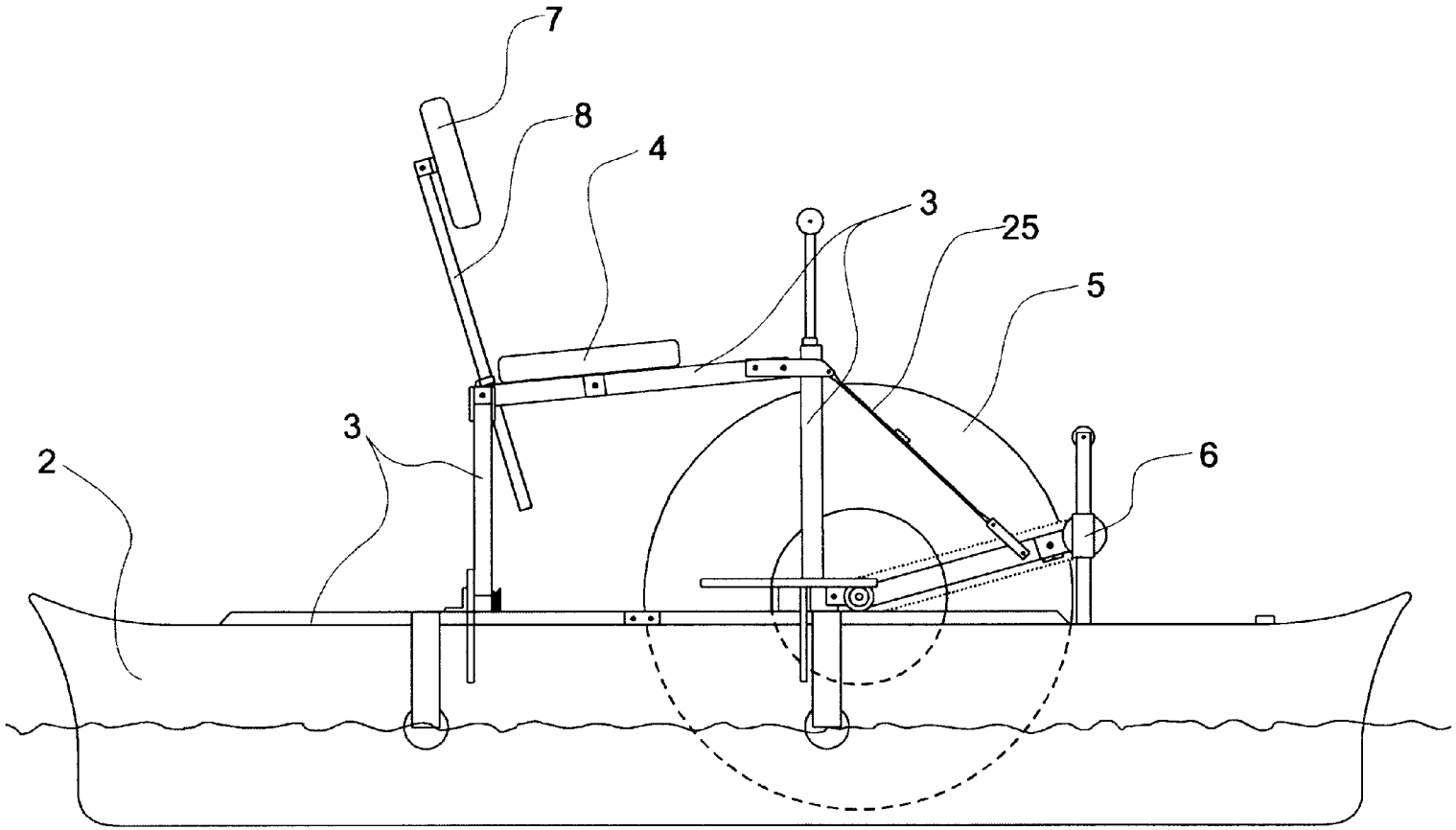
FIG. 3 is a starboard side view of the paddlewheel boat viewed along lines A—A of FIG. 2.
Figure 4:
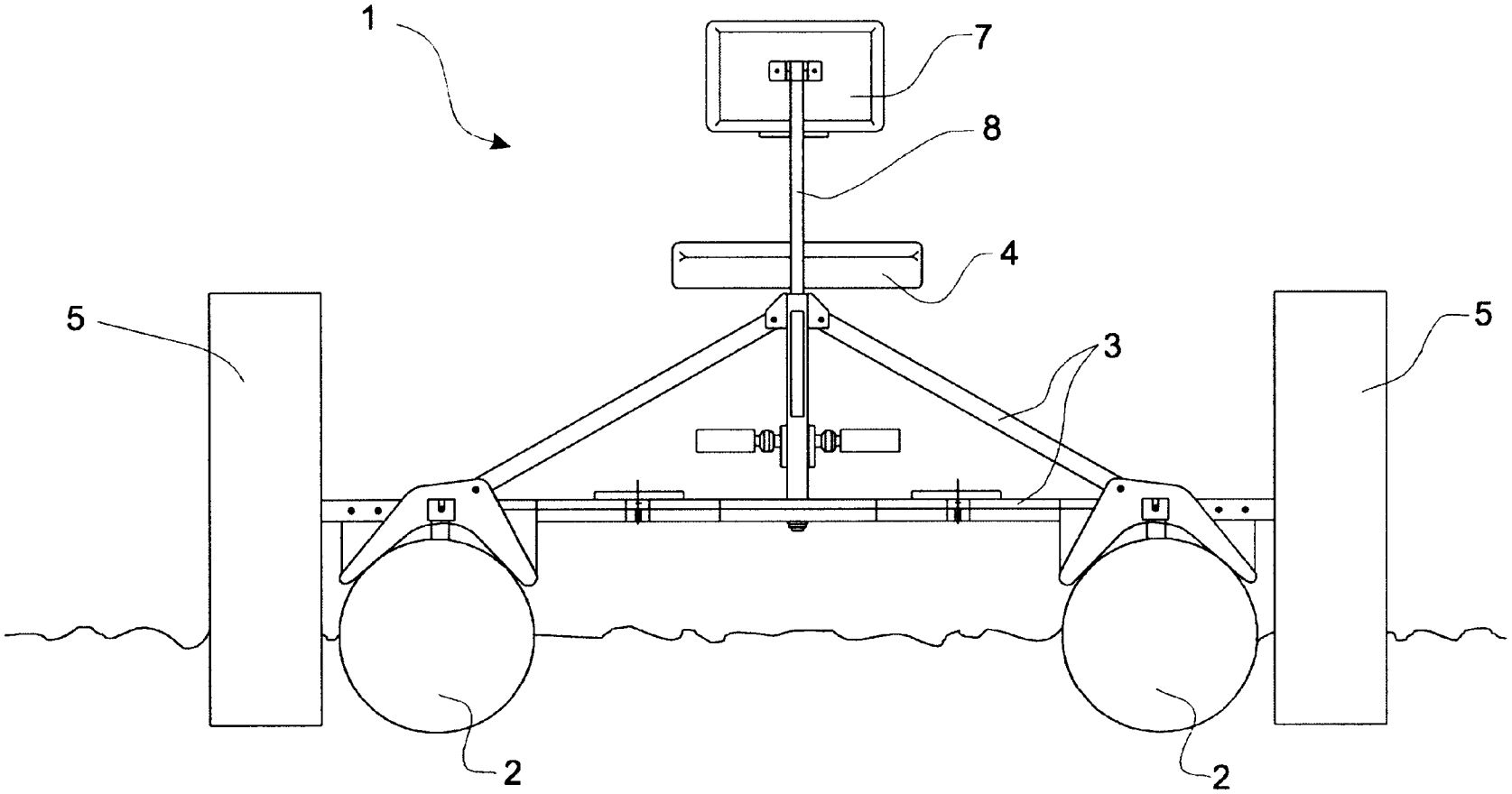
FIG. 4 is a stern view of the boat along lines B—B of FIG. 2 with paddlewheel detail omitted.

Referring to FIGS. 1 and 3, the distance between the position of the seat 4 and the pedal drive 10 is adjustable. A tether 25, attached to the steering column by a bolt, connects the swing arm 18 to the frame 3. Shortening of the tether 25 causes the swing arm 18 to rotate upwardly about the drive axle 12, drawing the pedal drive 10 closer to the operator. The swing arm 18 can be drawn upwardly to a substantially vertical position, enabling hand operation of the pedal drive's cranks 16. Lengthening of the tether 25 lowers the swing arm 18 for accommodating foot-operation regardless of the operator's leg stature.

Steering is accomplished by alternately decoupling one or the other of the port or starboard paddlewheels 5 from the drive axle 12. By decoupling the starboard paddlewheel and using only the port paddlewheel, the boat will turn right (to starboard).

Accordingly, referring to FIGS. 1, 6 and 7, means for steering comprise a T-handle 30 atop a steering shaft 31 located a steering column 32, and a bifurcate shifting fork 33. The T-handle 30 rotationally actuates the shifting fork 33 which engages each of the coupling means 15 for actuating them between an engaged position and a disengaged position. The steering shaft 31 extends downwardly through the bore of the frame's steering column 32. At the bottom of the steering shaft 31, a steering pin 34 extends perpendicularly to engage the shifting fork 33. The tip 35 of the steering pin 34 moves left and right in an arc when the T-handle 30 is rotated during steering.

The shifting fork 33 has two spaced tines 36 extending forwardly from a transverse laterally movable shifting shaft 37 supported at the steering column 32. A port 38 in the shifting shaft 37 accepts the tip 35 of the steering pin 34 so that left and right pin movement results in port and starboard movement of the shifting shaft 37 and tines 36.

Each tine 36 actuates a coupling means 15 between engaged and disengaged positions.

As shown in FIG. 2 and in greater detail in FIGS. 6 and 7, each coupling means 15 comprises a short cylindrical sleeve 40 affixed to the end of each driveshaft 13. The sleeve 40 has a bore 41 suitably sized for accepting one end of the cylindrical drive axle 12. The ends of the drive axle 12 are formed with semicircular slots 42 across the axle's diameter. Each sleeve 40 has a pin 43 extending diametrically across its bore 41. Spring-biasing 45 (FIGS. 1,7) normally causes the sleeve's pin 43 to engage the slot 42 when they rotationally align. Normally, both pins 43 of both driveshaft sleeves 40 engage the slots 42 of each end of the drive axle 12. Accordingly, when rotated, the drive axle 12 normally causes both paddlewheels 5 to rotate and results in straight progression of the boat 1.

Best shown in FIGS. 1 & 7, the driveshaft is supported by a bracket 80 and bushing 81 at the outboard end of the front spacing members 62. The spring-biasing 45 is a coil spring compressed between the bracket 80 and an inboard clamp 82 on the driveshaft. A sleeve 83 on the driveshaft interfaces with the bushing 81. When a shift fork tine 36 engages the coupling sleeve 40, the driveshaft 13 moves, compressing the spring 45, and the driveshaft sleeve 83 also moves but remains within the bushing 81.

Referring specifically to FIG. 6, when steering, turning port for instance, the operator rotates the T-handle counterclockwise to port, rotating the steering pin 34 left and moving the shifting shaft 37 to port. The port tine 36*p* contacts the port side sleeve 40*p*, moving it axially against the spring-bias, disengaging the port side sleeve's pin 43*p* from the drive axle's port side slot 42*p*. The starboard side shift arm tine 36*s* simultaneously moves axially to port without affecting the starboard side sleeve 40*s*, leaving it engaged. The net result, as illustrated in circular cross-sections 76,77,78, is that when drive axle 12 is rotated (illustrated at 77) the starboard driveshaft and paddlewheel continues to rotate (illustrated at 78), the port side driveshaft and paddlewheel is idle (illustrated at 76) and the boat turns to port.

Figure 5B:
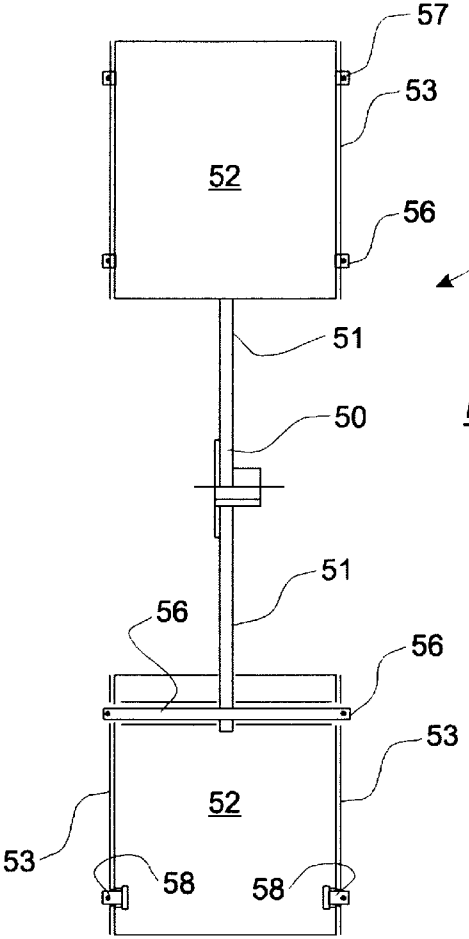
FIGS. 5*a*, 5*b* and 5*c* are detail views of the paddlewheels. Specifically.
Figure 5C:
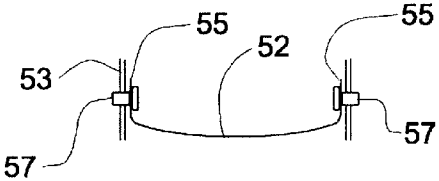
Figure 5A:
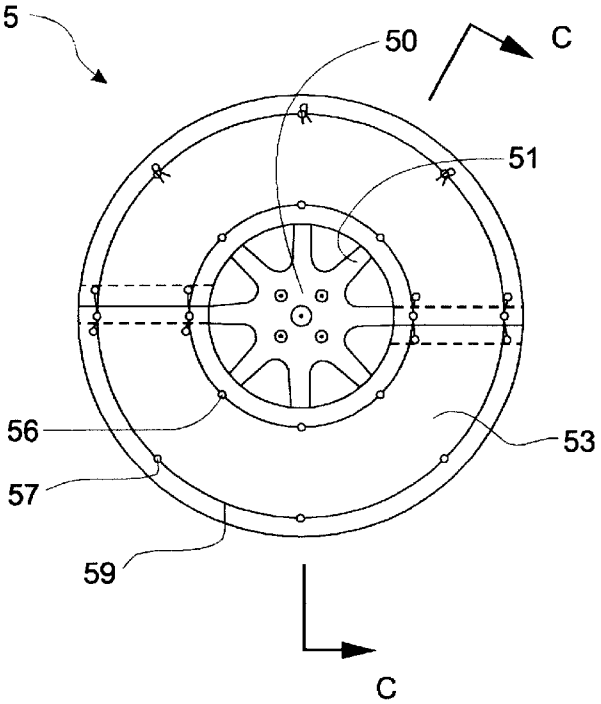

Having reference now to FIG. 1, 5*a*–5*c*, each paddlewheel is a lightweight assembly of a hub 50, a plurality of spokes 51 and radial paddles 52 (8 shown) and inboard and outboard disks having central holes 54 formed through their axes for forming annular walls 53 enclosing the radial edges of the paddles 52. The annular walls 53 and paddles 52 are manufactured of strong thin material such as ABS plastic. As shown in FIG. 5*c*, each paddle is formed with a slightly concave cross-section with upturned mounting edges 55. The hub 50 and spokes 51 connect at the inside radius of the annular walls 53 using a corresponding number of transverse full paddle-width pins 56, spacing the walls 53. The paddles 52 are also fitted between the full width of the annular walls 53. The two full width inside radius pins 56 and two outside radius pins 57, are inserted through corresponding holes 58 in the paddles 52 and the inboard and outboard annular walls 53 for securing the paddles 53 therebetween. "R" shaped spring clips or locking wire 59 retain the pins within the annular walls, securing the paddlewheel assembly of paddles 52, walls 53 and pins 56,57 together.

The boat is collapsible for ease of portability and transport. The collapsed boat is suitably small for storage in another vehicle or convertible to a backpack.

Portability is achieved with a combination of features including deflatable pontoons 2, a collapsible frame 3 and the arrangement of the drive axle 12 and coupling means 15.

Having reference to FIG. 1, 8–10 the pontoons 2 are deflated. The pontoons 2 and paddlewheels 5 are removed. The frame 3 is folded at a number of pivot points. To enable pivoting and collapse of the frame, some frame fasteners are removed and others forming the pivot points are loosened.

More specifically, as shown in FIG. 1, fasteners are labeled according to their function in the frame collapse. Removable fasteners are labeled R and those which are merely loosened to permit pivoting are labeled L. Each frame member which pivots is identified with an S and an arrow indicating its direction of collapse. In describing the collapse of the boat, references to the axis of rotation of frame members are as they are positioned before collapse and more specifically as follows: transverse refers to an axis extending substantially horizontally and between the port and starboard sides of the boat; inline refers to an axis extending substantially horizontally between the boat's bow and stern; and vertical axis being self-evident.

The frame 3 comprises a plurality of tubular members 32,60,61,62. The substantially vertical steering column 32 has a substantially horizontally extending seat support 60 extending substantially parallel to the pontoons 2 and centered therebetween. The seat support 60 is pivotally connected at its front end to the steering column 32.

Port and starboard rear spacing beams or members 61 extend diagonally between the stern end of the seat support 60 and pontoons 2. The rear spacing members 61 are pivotally connected at the seat support 60 and removeably connected at the pontoons 2. A cable 63 extends between the pontoons 2 at the rear spacing members 61 to prevent spreading of the pontoons 2.

Port and starboard front spacing beams or members 62 extend horizontally between the bottom of the steering column 32 and the pontoons 2. The front spacing members 62 are removeably connected at the pontoons 2 and connected to the steering column 32. A footrest 9 is positioned on each of two front spacing members 62, about midway between the steering column 32 and the paddlewheels 5.

The frame 3 further comprises port and starboard distribution beams 64, each having bow 64*a* and stern members 64*b* for distributing and supporting the operator and frame weight on the pontoons 2.

The pontoons 2 are secured to the distribution beams 64 using straps 65 (FIG. 1) positioned at the rear and front spacing members 61,62. Additionally, for each pontoon 2, outboard and inboard front guides 66 are provided for straddling the pontoon 2 at the front spacing member 62 and one inboard guide 67 is provided at the rear spacing member 61.

For collapsing the boat 1, the pontoons are deflated and folded into small packages 75. The frame 3 is then folded. It is understood that the order of collapse of the frame 3 can be varied without affecting the final collapsed transportable state.

Accordingly, the paddlewheels 5 are removed from the ends of the driveshafts 13 by removing the retaining clips that secure the hub 50.

The backrest 7 and tube 8 is removed from the seat support 60.

A bolt Al is removed so that the stern distribution members 64 can be folded under the bow distribution member 64*b*. The vertical axis bolt pivot A2 is loosened and both distribution members 64*a*,64*b* are swung thereabout so as to lie transverse and parallel with the front spacing members 62. Note that the front pontoon guides 66 are positioned on opposing sides of the front spacing member 62 so that they need not be removed.

Each pivotal connection of each rear spacing member 61 and the seat support 60 comprises a bracket 70 secured at the stern of the seat support 60. Each bracket 70 is pivotable about a transverse axis bolt pivot B and inline axis bolt pivots C1, C2 for connection to the rear spacing members 61.

Bolt pivots C1 and C2 are loosened. The pontoon ends of the rear spacing members 61 are pivoted about B, first 90 degrees up from their functional position towards the boat's bow, then pivoted about C1 and C2 a further 60 degrees or so to lie parallel to and either side of the seat support 60.

A pair of parallel flat brackets 71 are welded to either side of the top of the steering column 30. The flat brackets 71 extend horizontally and rearward. Two transverse axis bolts D,E secure the seat support between the flat brackets 71. Bolt D, closest to the steering column, is removed and the other bolt E is loosened to allow the seat support 60 and collapsed rear spacing members 61 to both be pivoted downward 90 degrees about E until the seat support 60 lies parallel to and rearward of the steering column 32. The tether 25 is attached to bracket 71 wit ha transverse axis bolt H. Bolt H later is used to support the backrest tube 8 once the frame 3 is collapsed.

Left and right brackets 72 extend transversely from the bottom of the steering column 32 for connection to the front spacing members 62. Inline axis bolts F1,F2 are located in the distal ends of the brackets 72. The bolts F1,F2 pass through corresponding pivots points offset inwardly from the inboard ends 73 of the front spacing members 62.

Bolt G is removed for enabling removal of parallel and spaced pinch plates 74 which sandwich and prevent rotation of the inboard ends 73 of the front spacing members 62.

The driveshafts 13 are manually decoupled from the short drive axle 12 so that the front spacing members 62 can be rotated about bolts F1,F2 without damaging the coupling means 15. The driveshafts 13 hang from the outboard ends of the front spacing members 62 and are loose enough to be tucked somewhere into the folding frame. Accordingly, both front spacing members 62 and associated driveshafts 13 are rotated 90 degrees upwardly to lie substantially parallel with and on either side of the steering column 32. The footrests can be pivoted parallel with the front spacing members 62

The pedal drive swing arm 18 is pivoted upwardly about its attachment to the drive axle 12 so as to lie substantially parallel to and in front of the steering column 32.

Figure 10:
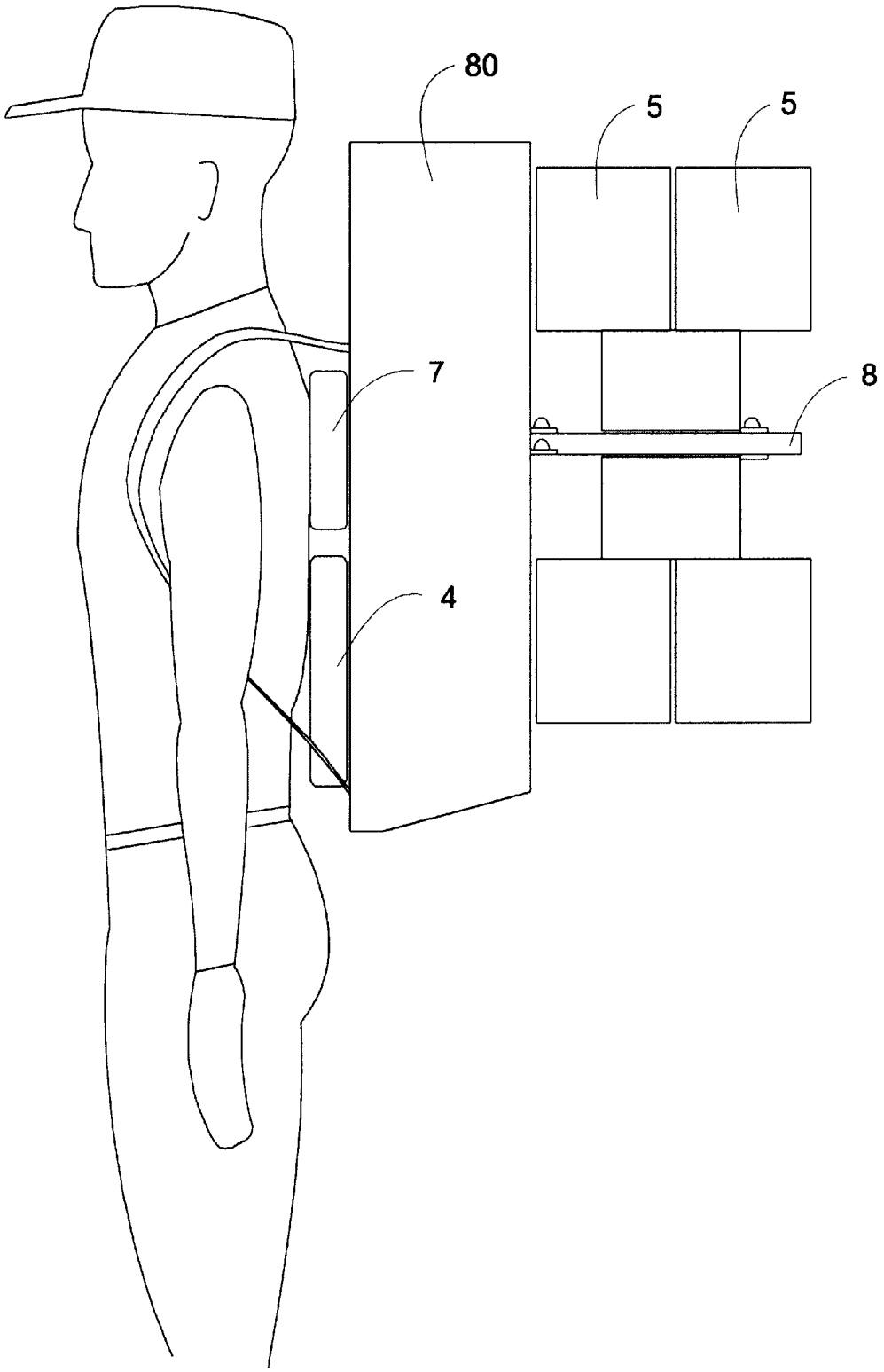
FIG. 10 is a side view of an operator and the paddleboat with the folded frame, paddlewheels and deflated pontoons being flipped top to bottom from that depicted in FIG. 8 and worn by the operator as a backpack.

As shown in FIG. 10, the collapsed boat forms a bundle 80 with the seat 4 forming the back of the bundle 80 for acting as a padded support for carrying the boat 1 as a backpack. The deflated pontoon packages 75 are stored on the bundle 80. As is shown further in FIG. 9, the backrest 7 and backrest tube 8 can be separated, the backrest being pinned to the seat support member 60 at old pivot E for providing further back support for the backpack. The backrest tube 8 is secured to the steering column bracket 71 where the tether used to be. When so secured, the tube 8 projects substantially perpendicular to the steering column 32, the tube's diameter being sized so as to be fitted through the paddlewheel's hub 50 for supporting the paddlewheels 5 for transport.

As an example, a boat was assembled using an aluminum frame having an approximate tare weight of only 27 pounds. Fully assembled, this lightweight boat had approximate outside dimensions of 72 inches long by 66 inches wide by 27 inches high at the seat and 40 inches high at the top of the backrest. This configuration was stable, even with the operator standing. Collapsed and without wheels, the bundle was about 12 deep by 15 inches wide by 30 inches high.

The inflated pontoons were about 11 inches in diameter by 72 inches long for supporting an operator of about 200 pounds. Each of the two paddlewheels had a 6 inch width and an outside diameter of 24 inches with a 12 inch hole at the centerline, for 6 inch radial paddles. 8 foot long pontoons were found to be suitable for any normal loading since displacement and paddle-bite remain proportional. The above 11 inch diameter pontoons typically resulted in a shallow drought of less than 5½ inches, also promoting an efficient bite for the paddlewheel paddles.

The two-pontoon boat had a cruising speed of 3 to 5 miles per hour under adult power. The outboard position of the paddlewheels resulted in a powerful turning action with a minimum turning radius of about 6 feet.

As stated, lightweight aluminum was used for the frame but was also used for the driveshafts, steering components, pedals, swing arm and cranks. Critical stress components like fasteners, axles, coupling sleeves, cable and springs were manufactured of stainless steel with conventional sprockets and chain being a form of carbon steel. Bushings for the driveshafts and axles were bronze. Paddlewheels were manufactured of 1/16" inch thick ABS Plastic and the hubs and spokes of ⅜ inch thick Intecel, a trade name for a foam PVC plastic, available from Commercial Plastics, Calgary, Alberta. The pontoons, and cushion covers were constructed of vinyl. Assorted inserts, pedal bushings, and paddlewheel pins were formed of nylon.

The embodiments of the invention for which an exclusive property or privilege is claimed are defined as follows:

1. A human-powered paddlewheel boat comprising:

(a) two linear pontoons spaced apart and parallel;

(b) a tubular frame supported on the pontoons and having an operator's seat attached to the frame for positioning the operator near the boat's center of gravity;

(c) two paddle wheels, one positioned on the outboard side of each pontoon and having independent rotary drive shafts;

(d) a pedal drive and means for transmitting drive to a drive axle;

(e) a left and right coupling means for independently coupling the drive axle to the left and right driveshafts respectively, each coupling being actuable between released and engaged states so that when in an engaged state, rotation of the drive axle rotates its respective driveshaft, and when in a released state, rotation of the drive shaft does not rotate its respective driveshaft; and (f) steering means having a shifting fork with left and right tines for actuating the left and right coupling means respectively so that when the operator manipulates the steering means to turn the boat, the left and right shift tines actuate the left and right coupling means, the coupling on the inside of the turn being actuated to the released state and the coupling on the outside of the turn being actuated to the engaged state.

2. The apparatus as described in claim 1 wherein the left and right coupling means comprise complementary pins and slots formed in the drive axle and driveshafts.

3. The apparatus as described in claim 2 wherein the steering fork's left and right shifting tines actuate the left and right coupling means between the released and engaged states by engaging their respective coupling and moving its pin and slot axially apart or together a sufficient amount so as to rotationally de-couple or to rotationally couple the drive shaft from the drive axle.

4. The apparatus as described in claim 3 wherein the steering means comprises (a) a steering shaft having top and bottom ends;

(b) a hand-operated steering member connected to the steering shaft's top end; and (c) a shifting pin extending laterally from the steering shaft's bottom end for engaging and actuating the shifting fork to move left and right in response to left and right actuation of the steering member.

5. The apparatus as described in claim 4 wherein the pedal drive and transmission means are supported on a swing arm rotatably mounted about the drive axle, the position of the pedal drive being fixed by a tether extending between the swing arm and the frame.

6. The apparatus as described in claim 5 wherein the length of the tether is adjustable for altering the position of the swing arm and pedal drive for accommodating a wide range of pedal positions without altering the distance between the pedal drive and drive axle.

7. The apparatus as described in claim 6 wherein the length of the tether is adjustable so that the pedal drive is adjacent the steering means permitting hand operation.

8. The apparatus as described in claim 7 wherein the boat is collapsible for transport wherein (a) the pontoons are deflatable;

(b) the paddle wheels are removable;

(c) the frame is collapsible; and (d) left and right coupling means are located adjacent the drive axle and are manually releasable from the drive shafts so that the drive shafts are free to be collapsed.

9. The apparatus as described in claim 8 wherein the collapsible frame comprises:

(a) a substantially vertical steering column;

(b) a substantially horizontally extending seat support member pivotally connected at its front end to the steering column;

(c) rear spacing members pivotally extending between the rear end of the seat support member and the left and right pontoons, being removeably connected at the pontoons and pivotally connected to the seat support member;

(d) front spacing members extending between the steering column and left and right pontoons respectively, the front spacing members being removeably connected at the pontoons and pivotally connected to the steering column so that the boat is collapsible, in no particular order, by i) deflating and removing the pontoons, ii) removing the paddlewheels from the driveshafts, ii) manually releasing the left and right couplings from the driveshafts, iv) releasing the rear spacing members from the pontoons, v) pivoting the front spacing members and driveshafts parallel to the steering column, vi) pivoting the rear spacing members parallel with the seat supporting member, vii) pivoting the rear spacing members and seat supporting member parallel with the steering column, viii) rotating the pedal drive swing arm parallel with the steering column so that the frame is collapsed into a plurality of substantially parallel members.

10. The apparatus as described in claim 9 wherein the rear spacing members comprise left and right beams extending diagonally between the left and right pontoons respectively and a cable extending between the pontoons.

11. The apparatus as described in claim 10 wherein the front spacing members comprise left and right beams extending substantially horizontally between the left and right pontoons respectively and means for securing them together as a continuous beam.

12. The apparatus as described in claim 11 wherein the seat forms a backrest and the collapsed frame is worn as a backpack.

13. The apparatus as described in claim 12 wherein the seat support member incorporates a backrest and backrest shaft so that when the frame is collapsed, the backrest shaft extends substantially perpendicular to the steering column and permits the paddle wheels to be mounted temporarily thereon for transport.

14. The apparatus as described in claim 13 wherein the left and right rear spacing members extend diagonally from the rear end of the seat supporting member to the respective pontoons and are further spaced by a tension cable extending horizontally from the base of one rear supporting member to the base of the other rear supporting member and the left and right front supporting members extend horizontally from the steering column to each respective pontoon.

* * * * *